US005765377A

United States Patent [19]

Kim

[11] Patent Number: 5,765,377

[45] Date of Patent: Jun. 16, 1998

[54] COOLER CONSTRUCTION OF STIRLING ENGINE

[75] Inventor: Sung-Tae Kim, Seoul, Rep. of Korea

[73] Assignee: LG Electronics Inc., Seoul, Rep. of Korea

[21] Appl. No.: 708,509

[22] Filed: Sep. 5, 1996

[30] Foreign Application Priority Data

Sep. 5, 1995 [KR] Rep. of Korea ..... 1995-28911

[51] Int. Cl.[6] ..... F25B 9/00

[52] U.S. Cl. ..... 62/6; 60/520; 165/79; 165/173

[58] Field of Search ..... 62/6; 165/79, 173; 60/520

[56] References Cited

U.S. PATENT DOCUMENTS 2,484,392 10/1949 Van Heeckeren ..... 62/6

2,907,175 10/1959 Kohler et al. ..... 62/6

4,295,522 10/1981 Frei ..... 165/79

4,546,822 10/1985 Tamura ..... 165/79

*Primary Examiner*—Ronald C. Capossel

[57] ABSTRACT

A cooler structure of stirling engine is designed to make it easier for the production of the cooler by using brazing soldering techniques, and which in turn reduces the loss of the heat being transmitted to the cooling water and the displacer seal. The invention includes a sealing filler metal having the same depth formed around the circumference of each surface of the upper and lower plates which seals the radiator tubes to be fixed and sustained by the upper and lower plates. An adiabatic part is formed between the upper plate having a projection maintaining a predetermined length toward the inner low part. The internal cylinder prevents the passing of the heat from the internal cylinder to the radiator tube.

12 Claims, 2 Drawing Sheets

COOLER CONSTRUCTION OF STIRLING ENGINE

BACKGROUND OF THE INVENTION

The present invention relates to a cooler construction of Stirling engine, and more particularly, to a cooler structure of Stirling engine capable of making it easier for the production of a cooler by using a brazing solder method, and reducing the loss of heat being transmitted to cooling water by limiting the contacting part of the cooling water and a displacer seal.

As shown in FIGS. 1 and 2, the structure of the conventional stirling engine and its surrounding area comprises the following elements:

A cylinder head 1 arranged at the upper part of the stirling engine cylinder, an external cylinder 2 to be connected with the lower part of the cylinder head 1, an internal cylinder 3 arranged at the interior of the external cylinder 2 to perform its function as the guide of the displacer 4. The displacer 4 reciprocates inside the internal cylinder 3. A displacer seal 15 is connected to the displacer 4 to prevent the leaking of refrigerant. A power piston 5 is connected with the displacer 4 by a shaft, and a heater tube 6 is connected to the upper part of the cylinder head 1 to acquire heat energy from the external heat source. A radiator tube 8 functions as a passage of the refrigerant circulating within the heater tube 6 to make it pass through a regenerator 7, and to radiate the highly heated refrigerant. An upper plate 9 is placed on the top of the radiator tube 8 and to fix the radiator tube 8, a lower plate 10 to fix the radiator tube 8 is at its lower part toward the direction of the upper plate 9. A filler metal 16 connecting to the radiator tube 8 is fixed and retained by the upper and lower plates 9 and 10. A cooling water inlet 11 is formed at the external cylinder 2 to suck the cooling water absorbing the heat of the refrigerant in the radiator tube 8. A cooling water outlet 12 formed at the external cylinder 2 to spout out the cooling water sucked at the cooling water inlet 11 after the cooling water has absorbed the heat of the radiator tube 8. An expansion space 13 is formed among the cylinder head 1, internal cylinder 3 and displacer 4; and a compression compartment 14 is formed between the displacer 4 and power piston 5.

The operational motion of the conventional stirling engine structured as above and its problems are described in the following:

As shown in the FIGS. 1 and 2, the stirling engine employs the principle that the pressure rises when the gas kept in a tightly sealed container while it is heated, and the the pressure drops when the gas in the tightly sealed container is cooled down.

As the displacer 4 and the power piston 5 reciprocate inside the internal cylinder 3, the refrigerant flows out from the compression compartment 14 to the expansion space 13 through the radiator tube 8, regenerator 7 and the heater tube 6, and thereby the pressure rises up. The rised pressure then acts on the power piston 5 head and presses down the power piston 5.

On the contrary to the above, when the refrigerant flows from the expansion space 13 to the compression compartment 14 through the heater tube 6, regenerator 7 and the radiator tube 8, the refrigerant is cooled down and thereby the pressure drops. The dropped pressure pushes up the power piston 5.

Therefore, the principle of the operational motion of the stirling engine derives from the result of repeated heating and cooling of the refrigerant. For the heating and cooling of the refrigerant, the heat capacity needed during the expansion in the expansion space 13, formed within the internal cylinder 3, is gained through the heater tube 6 accepting the heat energy from outside heating sources. The heat generated during the compression inside the compression compartment 14 is cooled down by the cooling water circulating around the radiator tube 8.

At this time, the cooling water flows in through the cooling water inlet 11 formed at the external cylinder 2 to cool down the highly heated refrigerant inside the radiator tube 8 as circulating around the radiator tube 8. After being heated, the cooling water is then spouted out through the cooling water outlet 12 formed at the external cylinder 2.

By operating as above, the cylinder head 1 is formed on the upper part of the external cylinder 2 of the stirling engine by a welding or brazing method.

The radiator tube 8, performing as a passage of the refrigerant as well as radiating the heat of the refrigerant, is fixed and sustained by the upper and lower plates 9 and 10. As shown in the FIG. 2, the filler metal 16, by either welding or melting on each radiator tube 8, is placed on each one of the radiator tubes 8 for brazing, thus the gaps between the radiator tubes 8 and the upper and lower plates 9 and 10 are sealed together.

However, since the conventional stirling engine demands the sealing of each tube of the radiator within a narrow space between the upper and lower plates and the radiator tubes, the sealing process requires much expenses while providing low reliability for their airtightness.

In addition to the above, when performing the work for welding and brazing, the intervals between radiator tubes had to be maintained uniformly, thus problems limiting the number of radiator tubes to be set within a certain area of space existed, and required the accurate processing of the external measurement of the holes formed on the upper and lower plates and of the radiator tubes.

Since the entire part of the internal cylinder was formed in one structure passing the heat from high heat in the upper section to low heat in the cooling water section, a problem existed with the loss of heat.

SUMMARY OF THE INVENTION

Accordingly, it is an object of the present invention to provide a cooler construction of a stirling engine capable of reducing the loss of the heat to be sent to the cooling water by facilitating the production of the cooler with the use of brazing method, and by limiting the contacting portion of the cooling water and the displacer seal.

According to the present invention, a cooler construction of a Stirling engine comprises the following parts: Sealing means formed at the upper and lower plates for sealing the radiator tubes being fixed and sustained by the upper and lower plates wherein the radiator tube is welded to said sealing means by using a melted filler metal; adiabatic means placed between the upper plate and the internal cylinder for cutting off the passage of heat generated from the internal cylinder to the radiator tube; and airtight means for preventing the leakage of the cooling water around the circumference of the upper and lower plates.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
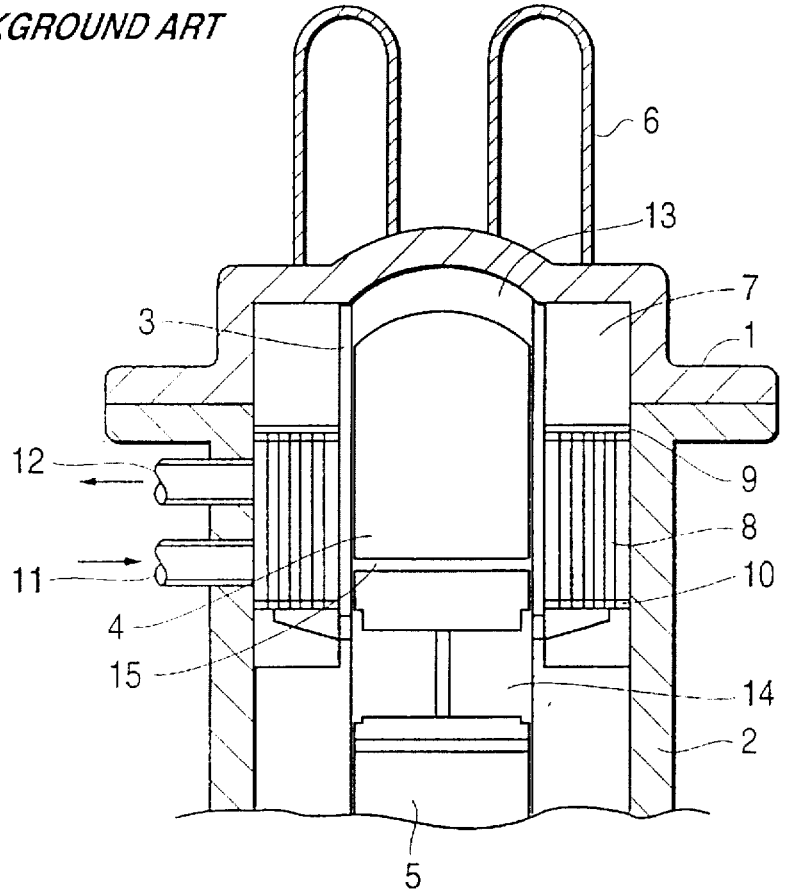
FIG. 1 BACKGROUND ART
FIG. 1 is a vertical cross sectional view of a stirling engine according to the conventional art.
Figure 2A:
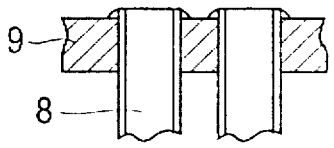
FIG. 2(A) BACKGROUND ART
FIG. 2A is a cross sectional view showing the connection of the radiator tube with the upper plate by welding according to the conventional art.
Figure 2B:
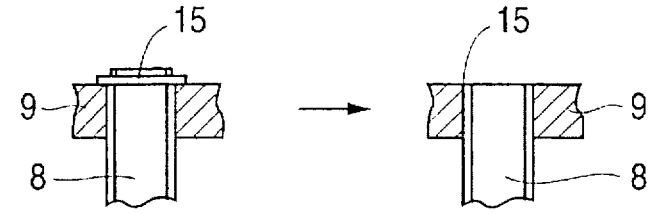
FIG. 2(B) BACKGROUND ART
FIG. 2B is a cross sectional view showing the connection of the radiator tube with the upper plate by brazing according to the conventional art.
Figure 3A:
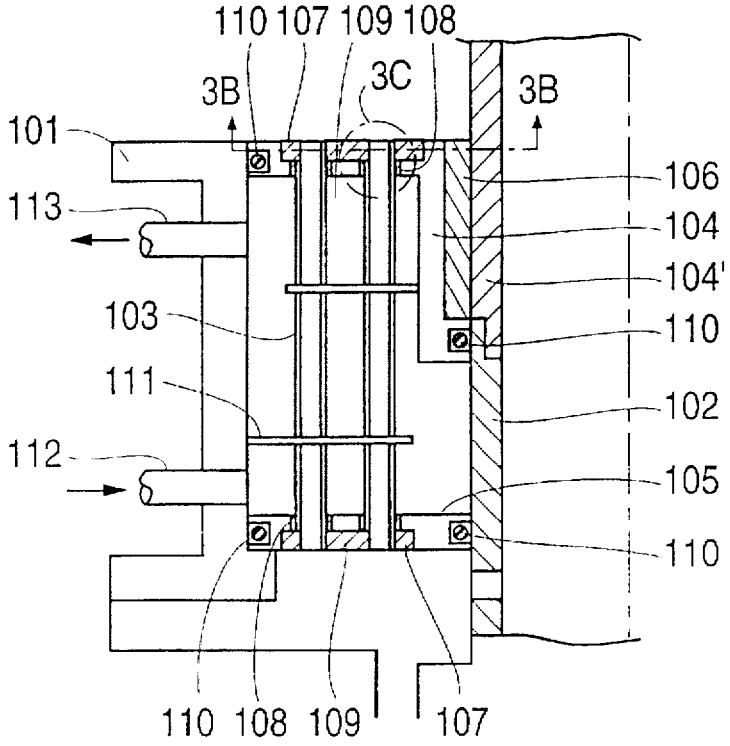
FIG. 3A is a vertical cross sectional view of a cooler of a stirling engine according to the present invention.
Figure 3B:
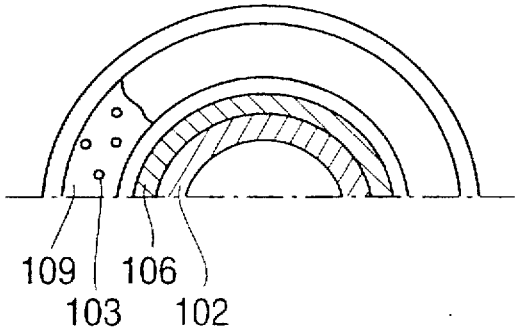
FIG. 3B is a cross sectional view taken along A–A' line of FIG. 3A.
Figure 3C:
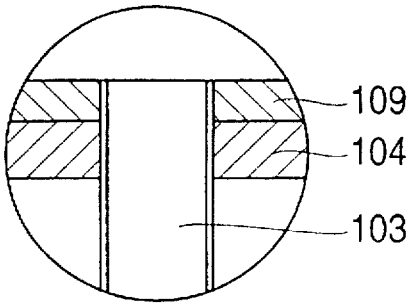
FIG. 3C is a enlarged view of portion C in FIG. 3A.

As shown in the FIG. 3, a cooler and its periphery of a Stirling engine of the present invention comprises the following elements:

An external cylinder 101 to be linked with a cylinder head arranged on the upper part of the cylinder of the stirling engine, an internal cylinder 102 arranged inside the external cylinder 101, consisting of two prominence and depression and guiding the displacer; a radiator tube 103 arranged between the external cylinder 101 and the internal cylinder 102, to radiate the heat; a cooling water inlet 112 arranged at the external cylinder 101, to support the cooling water absorbing the heat of the refrigerant in the radiator tube 103; a cooling water outlet 113 arranged at the external cylinder 101, to spout out the cooling water being sucked at the cooling water inlet 112 after the water absorbs the heat of the radiator tube 103; an upper plate 104 having a projection 104' extending at a predetermined length toward the lower direction inside and placed on the top of the radiator tube 103, to fix and support the radiator tube 103; a lower plate 105 placed under the radiator tube 103, to fix and support the radiator tube 103 by facing toward the upper plate 104; an adiabatic device 106 formed between the upper plate 104 and the internal cylinder 102 to cut off the passage of the heat; a groove 107 maintaining a predetermined depth around a circumference surrounding the surface of the upper plate 104 and the lower plate 105; a hole 108 formed in the groove 107 supporting the radiator tube 103; a filler metal 109 to seal and weld the radiator tube 103 being inserted in the hole 108 and by being filled in the groove 107 in a melted state, an airtight member 110 for preventing the leakage of the cooling water around the circumference of the upper and lower plates 104 and 105; and a baffle 111 placed between the external cylinder 101 and the internal cylinder 102, to help smoothly flow out the cooling from water cooling the radiator tube 103.

As shown in the FIG. 3, the upper and lower plates 104 and 105 are equipped with a lengthy stage, having a predetermined thickness, and having a groove 107 of a predetermined depth around the circumference of their surfaces.

The hole 108 is formed in the groove 107 and connects the radiator tube 103. As shown in the FIG. 3, after inserting the radiator tube 103 into the hole 108, the filler metal 109 for brazing is filled until it reaches the height more than the depth of the groove 107 formed at the upper and lower plates 104 and 105. As a result, the radiator tube 103 is brazed at the upper and lower plates 104 and 105 in a sealed state.

At this time, the length of the radiator tube 103 being connected to the upper and lower plates 104 and 105 is formed longer than the thickness of the upper and lower plates 104 and 105 and the filler metal 109 is also filled thicker than the depth of the groove. After the welding is finished, the unnecessary projected filler metal and radiator tube are trimmed.

With the establishment of the adiabatic member 106 between the upper plate 104 formed with the projection 104' having a predetermined length extending toward the lower direction inside and the internal cylinder 102 connected by the two prominence and depression, the heat generated inside the internal cylinder 102 is prevented from being passed in the direction of the radiator tube 103.

With the establishment of the airtight member 110 around the outside of the projection 104' formed at the upper plate 104 and of the lower plate 105, the airtight member 110 prevents the cooling water sucked through the cooling water inlet 112 from leaking through the cooling water outlet 113 after the cooling water has absorbed the heat of the refrigerant inside the radiator tube 103 being fixed and supported by the upper and lower plates 104 and 105.

The internal cylinder 102 is linked by the two prominence and depression at the airtight member 110 formed inside the upper plate 104. The cooling water sucked at the cooling water inlet 112 can prevent the loss of the heat as the displacer seal, a part of the internal cylinder 102, makes contact with only the part of the internal cylinder 102 where the displacer makes its reciprocation.

With the placement of the baffle 111 in the middle of the radiator tube 103, the cooling water being sucked through the cooling water inlet 112 is assured of smooth flow.

As it was explained above, with the extension of the length of the radiator tube to be linked with the groove formed at the upper and lower plates being longer than the thickness of the upper and lower plates, brazing filler metal is melted and welded in the groove formed at the upper and lower plates, thus the reliability of the airtightness can be improved.

Since the radiator tubes are not linked with the upper and lower plates one by one, the intervals between the radiator tubes cause no problem and the number of the radiator tubes in a certain area can be set to the maximum extent possible, thus the processing of the radiator tubes is simple and the cost of the processing can also be reduced.

The cooling water sucked at the cooling water inlet makes contact only with the part where the displacer seal formed by the prominence and depression in the internal cylinder when the cylinder is reciprocating, thus the loss of the heat inside the internal cylinder can be prevented.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A cooler structure of a Stirling engine comprising:

a first cylinder;

adiabatic means adjacent and outside said first cylinder;

a first circular plate outside said adiabatic means, said first circular plate including a first air tight means for preventing leakage of cooling fluid, said first air tight means contacting said first circular plate and said first cylinder, said adiabatic means being substantially enclosed by said first circular plate and said first cylinder;

a second circular plate spaced from said first circular plate and outside said first cylinder, said second circular plate including a second air tight means for preventing leakage of cooling fluid, said second air tight means contacting said second circular plate and said first cylinder, said first and second circular plates including a plurality of corresponding holes, said holes being spaced apart relative to each other at predetermined distances;

a second cylinder outside and supporting said first and second circular plates;

a plurality of radiator tubes having open ends, said radiator tubes being supported by said holes in said first and second circular plates, said ends of said radiator tubes penetrate through said holes to a height above said first and second circular plates to form grooves outside said radiator tubes and on said first and second circular plates;

means for sealing the radiator tubes in said holes and filling said grooves, whereby heat loss through a section in said first cylinder adjacent said first cylinder plate is substantially reduced.

2. The cooler structure of claim 1, wherein said means for sealing includes filler metal melted and welded in said grooves.

3. The cooler structure of claim 1, wherein said means for sealing includes brazened filler metal, said grooves are filled above said height of said radiator tubes.

4. The cooler structure of claim 1, wherein said first and second airtight means includes a round ring seal.

5. The cooler structure of claim 1, further comprising a baffle structure surrounding mid portions of said plurality of radiator tubes to provide smooth flow of cooling fluid.

6. The cooler structure of claim 1, wherein said adiabatic means is enclosed on two sides by said upper circular plate and on one side by said first cylinder.

7. The cooler structure of claim 1, wherein said first circular plate comprises a ring plate portion for supporting said radiator tubes and a cylindrical tube portion parallel to said first cylinder and said radiator tubes.

8. The cooler structure of claim 7, wherein said first circular plate includes a two groove portions for supporting said first airtight means, one groove portion located outside said ring plate portion adjacent said second cylinder, and one groove portion located inside said cylindrical tube portion.

9. The cooler structure of claim 1, wherein said first circular plate is parallel to said second circular plate.

10. The cooler structure of claim 1, wherein said plurality of radiator tubes are parallel to each other and spaced apart at predetermined distances.

11. The cooler structure of claim 1, wherein said second cylinder includes cooling fluid inlet and outlet tubes.

12. The cooler structure of claim 11, wherein said cooling fluid inlet and outlet tubes are substantially parallel to each other and substantially perpendicular to said radiator tubes.

* * * * *